US006926622B1

(12) United States Patent
Yates

(10) Patent No.: US 6,926,622 B1
(45) Date of Patent: Aug. 9, 2005

(54) APPARATUS FOR RETRIEVING AND PLACING GOLF BALLS

(76) Inventor: Patrick D. Yates, 21417 Brewer Rd., Grass Valley, CA (US) 95949

( * ) Notice: Subject to any disclaimer, the term of this patent is extended or adjusted under 35 U.S.C. 154(b) by 1 day.

(21) Appl. No.: 10/695,701

(22) Filed: Oct. 29, 2003

(51) Int. Cl.[7] ..... A63B 57/00
(52) U.S. Cl. ..... 473/386; 473/286; 294/19.2
(58) Field of Search ..... 473/386, 406, 473/285, 286, 340; 294/19.2

(56) References Cited

U.S. PATENT DOCUMENTS 2,623,769 A 12/1952 Kegley, Sr.
4,248,430 A * 2/1981 Kepler ..... 473/285
4,313,604 A 2/1982 Baxter
4,580,784 A * 4/1986 Brill ..... 473/286
5,102,139 A 4/1992 Greig
5,540,432 A 7/1996 Keller
5,690,558 A * 11/1997 Huber ..... 473/285
5,692,968 A * 12/1997 Shine ..... 473/286
6,257,635 B1 7/2001 Torelli
6,348,017 B1 * 2/2002 Yates ..... 473/386
6,497,628 B1 * 12/2002 Gunderson ..... 473/340

* cited by examiner

*Primary Examiner*—Steven Wong
(74) *Attorney, Agent, or Firm*—Thomas R. Lampe

(57) ABSTRACT

A golf ball engagement and support member includes golf ball engagement and support arms of a size and configuration providing for the ready retrieval of a golf ball and facilitating placement thereof on a tee. The member also facilitates retrieval and placement of golf tees and ball markers.

9 Claims, 2 Drawing Sheets

APPARATUS FOR RETRIEVING AND PLACING GOLF BALLS

TECHNICAL FIELD

This invention relates to a golf ball engagement and support member for attachment to a shaft and employed to retrieve and place golf balls by an individual manipulating the shaft. The invention is suitable for use by physically challenged golfers as well as golfers in general. The invention is also employable to retrieve and place tees and ball markers.

BACKGROUND OF THE INVENTION

Placing and retrieving golf balls and tees by wheelchair bound or other physically challenged golfers can be a problem. Quite simply, it is difficult, and in some cases impossible, for an individual seated in a wheelchair to set the tee, tee-up the ball on the tee, retrieve the tee after hitting the ball down the fairway and retrieve the golf ball itself from the ground or from a cup.

My U.S. Pat. No. 6,348,017, issued Feb. 19, 2002, discloses apparatus for placing and retrieving golf balls and tees including a support block forming a recess to receive a tee top or head. Attached to converging surfaces of the support block are a tee impact plate used to pound a tee into the ground and a golf ball retainer including two arms having spaced ends and defining a recess for holding and carrying a golf ball. In addition, the support block supports a tubular-shaped retainer having an outwardly flared flange at one end thereof, the pick-up member being used to pick up tees and the flange also serving to retain the golf ball in position between the arms of the golf ball retainer.

Other arrangements for placing and retrieving golf balls, tees and the like are known and the following patents disclose arrangements of this type that are believed to be representative of the state of the art as well: U.S. Pat. No. 2,623,769, issued December, 1952, U.S. Pat. No. 4,313,604, issued February, 1982, U.S. Pat. No. 5,102,139, issued April, 1992, U.S. Pat. No. 5,540,432, issued July, 1996 and U.S. Pat. No. 6,257,635, issued July, 2001.

DISCLOSURE OF INVENTION

The present invention relates to a golf ball engagement and support member which is of inexpensive, relatively simple construction and which can readily and efficiently be used by physically challenged golfers and others for golf ball and tee retrieval and placement as well as positioning of a golf ball marker. The golf ball engagement and support member enables these various tasks to be carried out through simple manipulations thereof by a shaft attached thereto.

The golf ball retrieving and support member disclosed and claimed herein is of unitary construction and includes a first portion and a second portion. The first portion has a first portion top surface, a first portion bottom surface and a first portion rear surface. The first portion defines a hole for receiving the end of a shaft.

The second portion projects forwardly from the first portion and includes spaced first and second golf ball support and engagement arms defining a cavity for receiving a golf ball. The cavity is open at the top and bottom thereof whereby the cavity extends through the golf ball retrieving end support member.

The golf ball engagement and support arms have forwardmost disposed distal ends defining a space therebetween communicating with the cavity. The golf ball engagement and support arms also have proximal ends.

The space defined by the forwardmost disposed distal ends is smaller than the diameter of a golf ball. The golf ball engagement and support arms have curved golf ball engagement and support surfaces disposed about the cavity rearwardly from the distal ends thereof and converging at the first portion.

Other features, advantages and objects of the present invention will become apparent with reference to the following description and accompanying drawings.

BEST MODE FOR CARRYING OUT THE INVENTION

Figure 1:
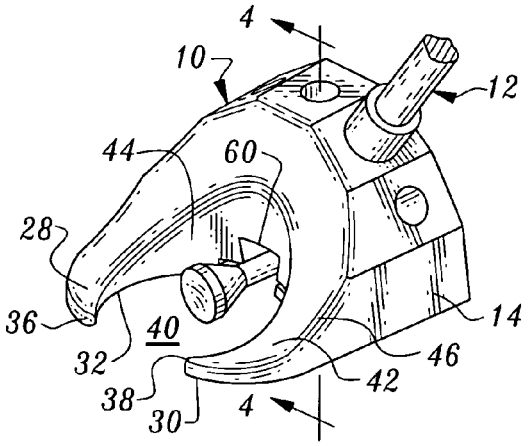
FIG. 1 is a perspective view of a golf engagement and support member constructed in accordance with the teachings of the present invention attached to an end of a shaft and retaining a golf tee.
Figure 2:
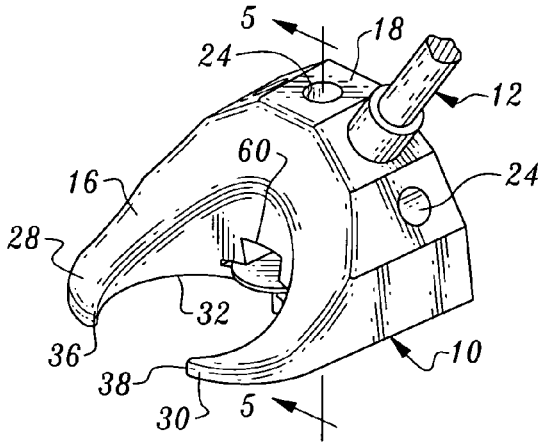
FIG. 2 is a view similar to FIG. 1, but showing the golf ball engagement and support member retaining a ball marker.

Referring now to the drawings, a golf ball engagement and support member constructed in accordance with the teachings of the present invention is identified by reference number 10. The member 10 is shown attached to a shaft 12 which is used by an individual to maneuver the golf ball engagement and support member.

The member 10 is of integral construction and may be formed of any suitable material such as metal, plastic or wood. The member includes a first or rear portion 14 and a second or frontal portion 16. The first portion 14 has a first portion top surface 18, a planar first portion bottom surface 20 and a first portion rear surface 22.

Figure 3:
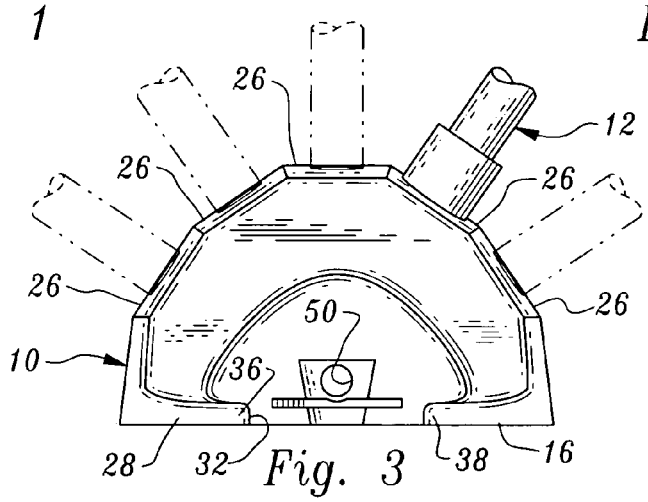
FIG. 3 is a front, elevational view of the golf ball engagement and support member and showing a shaft attached thereto at one location and depicting in dash lines four alternative shaft locations.

The first portion 14 defines a hole 24 for receiving an end of shaft 12. In the arrangement illustrated, the first portion top surface is comprised of a plurality of segments 26 angularly disposed relative to one another. Each of these segments has a hole 24 therein enabling a shaft to be installed on the golf ball engagement and support member in any one of a plurality of angular orientations. This is shown in FIG. 3 wherein alternative shaft positions are shown by dash lines.

Second portion 16 projects forwardly from the first portion 14 and includes spaced golf ball support and engagement arms 28, 30 defining a cavity 32 for receiving a golf ball 34.

The cavity 32 is open at the top and bottom thereof whereby the cavity extends through the golf ball retrieving and support member.

The golf ball engagement and support arms 28, 30 have forwardmost distal ends 36, 38, respectively. The distal ends define a space 40 therebetween communicating with cavity 32. The space 40 is smaller than the diameter of a golf ball.

The golf ball engagement and support arms have curved golf ball engagement and support surfaces disposed about the cavity rearwardly from the distal ends and converging at the first portion 14. The proximal ends of the arms join at the first portion.

The curved golf ball engagement and support surfaces each include an upper surface segment 42 and a side surface segment 44, the upper surface segments and side surface segments adjoining at a curved edge 46 sized to engage the lower half of a golf ball.

The golf engagement and support arms gradually decrease in both height and width in the direction of the distal ends thereof. The narrow and thin distal ends 36, 38 are pointed and directed toward one another. The upper surface segments 42 of the arms extend upwardly to and adjoin the first portion top surface 18.

The member 10 defines an elongated tee retention hole 50 in communication with cavity 32 where the side surface segments converge and extends therefrom into the first portion. The longitudinal he axis of the hole 50 is parallel to the planar first portion bottom surface 20 as well as to the bottoms of arms 28, 30, which are co-planar with the first portion bottom surface.

Figure 4:
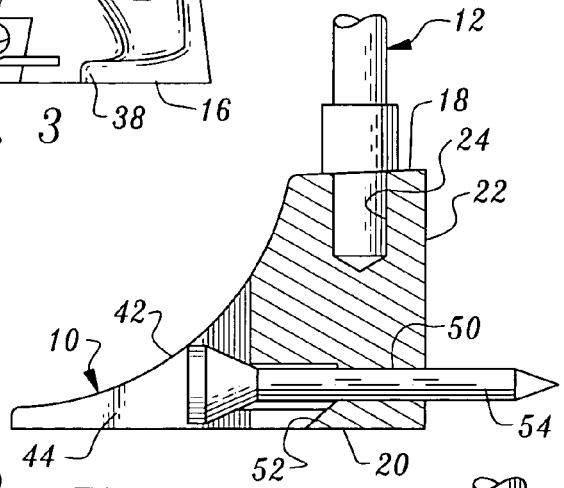
FIG. 4 is an enlarged, cross-sectional view taken along the line 4—4 of FIG. 1.
Figure 5:
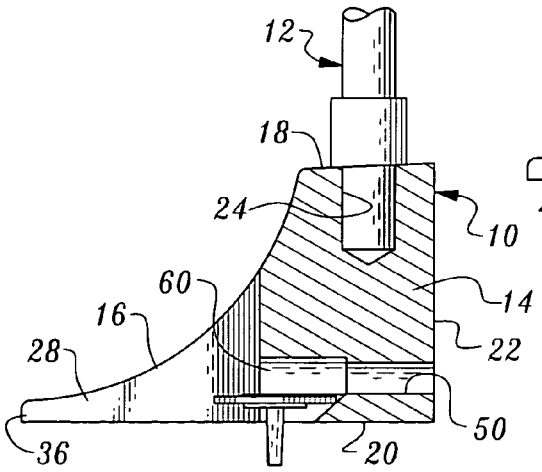
FIG. 5 is an enlarged, cross-sectional view taken along the line 5—5 of FIG. 2.
Figure 6:
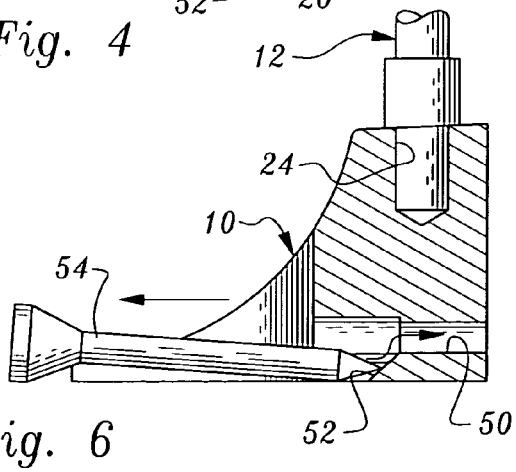
FIG. 6 is a cross-sectional view depicting the golf ball engagement and support member in the process of picking up a tee lying on its side.

The member 10 has a tapered tee guide surface 52 for guiding entry of a horizontally disposed golf tee into the tee retention hole when the golf ball engagement and support member engages the golf tee 54 as shown in FIG. 6. FIG. 4 shows the horizontally disposed golf tee 54 in position in the tee retention hole.

Figure 7:
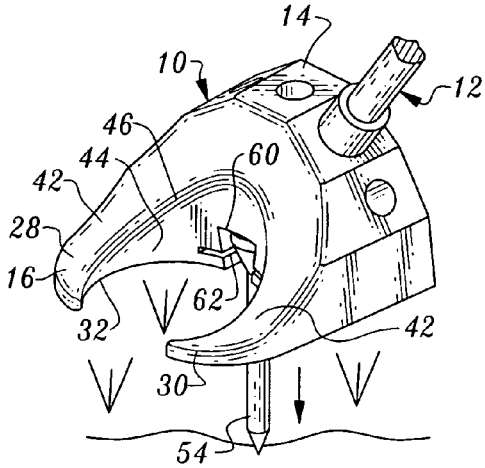
FIG. 7 is a perspective view illustrating the golf ball engagement and support member being utilized to place a tee in the ground.
Figure 11:
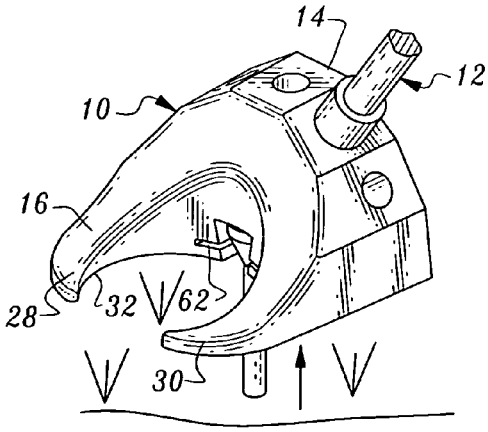
FIG. 11 shows the golf ball engagement and support member removing a vertically oriented golf tee from the ground.

The member 10 also defines a tee head retention recess 60 which communicates with the tee retention hole 50. The tee head retention recess is for releasably holding a tee in a vertical orientation when placing the tee into the ground (see FIG. 7) or extracting the golf tee from the ground (see FIG. 11).

Figure 9:
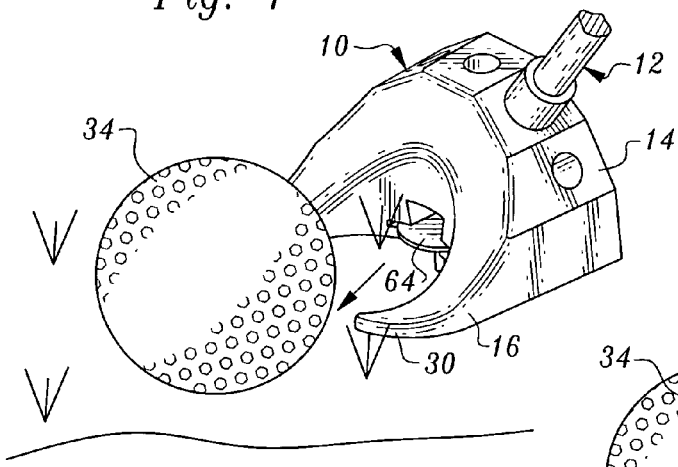
FIG. 9 is a perspective view of the golf ball engagement and support member just prior to picking up a golf ball from the ground and prior to placement on the ground of a golf ball marker.
Figure 10:
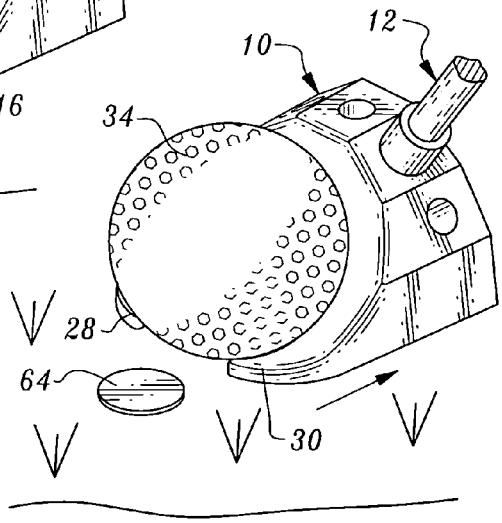
FIG. 10 is a perspective view showing the golf ball engagement and support member in the process of removing the golf ball from the ground and after the device has been utilized to place a ball marker in position.

A slot 62 communicates with the tee head retention recess for releasably holding a golf ball marker and permitting it to be positioned in place on the ground. FIG. 9 shows a marker 64 prior to its placement on the ground by the member 10 and FIG. 10 shows the marker on the ground. This is accomplished with simple manipulation of the member by the shaft.

Figure 8:
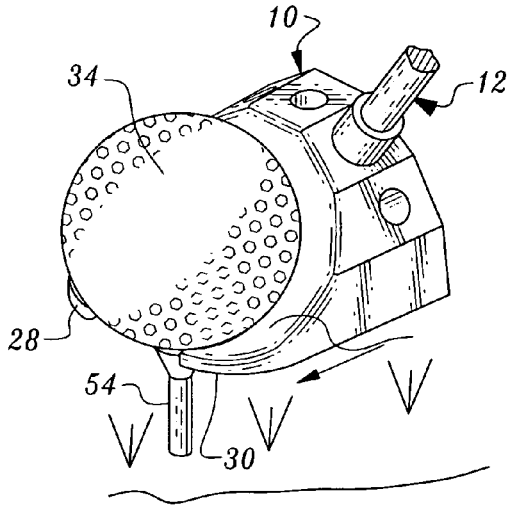
FIG. 8 is a perspective view of the golf ball engagement and support member being utilized to place a golf ball on a tee.

FIG. 8 shows use of the member 10 to place a golf ball on the tee. FIG. 9 illustrates the member being placed in position to capture the golf ball. FIG. 10 shows the golf ball captured by the member and being removed from the ground. The configuration of the arms allows them to be easily positioned under the ball and a slight tilting backward of the member fully seats the golf ball in captured position in the cavity 32 and between the arms.

The invention claimed is:

1. A golf ball engagement and support member for attachment to a shaft and employed to retrieve and place golf balls by an individual manipulating the shaft, said golf ball retrieving and support member being of unitary construction and including a first portion and a second portion, said first portion having a first portion top surface, a first portion bottom surface, and a first portion rear surface, said first portion defining a hole for receiving the end of a shaft, said second portion projecting forwardly from said first portion and including spaced first and second golf ball support and engagement arms defining a cavity for receiving a golf ball, said cavity being open at the top and bottom thereof whereby said cavity extends through said golf ball retrieving and support member, said golf ball engagement and support arms having forwardmost disposed distal ends defining a space therebetween communicating with said cavity and proximal ends, said space being smaller than the diameter of a golf ball, said golf ball engagement and support arms having curved golf ball engagement and support surfaces disposed about said cavity rearwardly from the distal ends thereof and converging at said first portion, said golf ball engagement and support arms gradually decreasing in height in the direction of the distal ends thereof and gradually decreasing in width in the direction of the distal ends thereof, the proximal ends of said golf ball engagement and support arms joining at said first portion, each of said curved golf ball engagement and support surfaces including an upper surface segment and a side surface segment, said upper surface segment and said side surface segment adjoining at a curved edge, and said golf ball engagement and support member defining an elongated tee retention hole in communication with said cavity and extending therefrom into said first portion.

2. The golf ball engagement and support member according to claim 1 wherein said upper surface segments extend upwardly to and adjoin the first portion top surface.

3. The golf ball engagement and support member according to claim 1 wherein said distal ends are pointed and directed toward one another.

4. The golf ball engagement and support member according to claim 1 wherein said first portion bottom surface and bottom surfaces of said golf ball engagement and support arms are flat and co-planar.

5. The golf ball engagement and support member according to claim 1 having a tapered tee guide surface for guiding entry of a golf tee into said tee retention hole when said golf ball engagement and support member engages the golf tee.

6. The golf ball engagement and support member according to claim 1 defining a tee head retention recess communicating with said tee retention hole, said tee head retention recess for releasably holding a tee in substantially vertical orientation when placing a golf tee into the ground or extracting a golf tee from the ground.

7. The golf ball engagement member according to claim 6 defining a slot communicating with said tee head retention recess for releasably holding a golf ball marker.

8. The golf ball engagement and support member according to claim 1 wherein said first portion top surface is comprised of a plurality of planar segments angularly disposed relative to one another.

9. The golf ball engagement and support member according to claim 1 being of integral construction.

* * * * *